United States Patent [19]

Monahan

[11] 4,002,925

[45] Jan. 11, 1977

[54] WALL-MOUNTED AUTOMATIC TIMER AND MANUAL ON-OFF LIGHT SWITCH

[76] Inventor: Brian J. Monahan, 7318 Norfolk Drive, Wichita, Kans. 67206

[22] Filed: July 3, 1975

[21] Appl. No.: 592,990

[52] U.S. Cl. ..... 307/141; 315/360

[51] Int. Cl.[2] ..... H01H 7/00

[58] Field of Search ..... 307/141, 141.4, 141.8, 307/293; 328/129, 130; 340/309.1; 315/360; 317/141 S

[56] References Cited

UNITED STATES PATENTS

| | | | |
|---|---|---|---|
| 3,391,305 | 7/1968 | Bradwin et al. | 317/141 S |
| 3,940,660 | 2/1976 | Edwards | 315/360 |

*Primary Examiner*—David Smith, Jr.
*Attorney, Agent, or Firm*—Wallenstein, Spangenberg, Hattis & Strampel

[57] ABSTRACT

A timer and manual on-off switch forms an assembly having the appearance and function of a conventional wall-mounted light switch. The timer and manual on-off switch preferably includes a toggle arm projecting from the wall, the arm being movable to a stable power turn-on position where the lights controlled thereby are turned on, a stable power turn-off position where the lights involved are turned off, an unstable timer on setting position which establishes as the time the lights involved are to be turned on when the arm is set for automatic operation the time the toggle arm is momentarily moved thereto, and an unstable timer off setting position which establishes as the time when the lights involved are automatically turned off the time the toggle arm is momentarily moved thereto. The automatic timer is set into operation by moving the toggle arm to a normal unstable neutral position when it is held in such position by shifting the toggle arm laterally into a self-holding position.

18 Claims, 10 Drawing Figures

WALL-MOUNTED AUTOMATIC TIMER AND MANUAL ON-OFF LIGHT SWITCH

BACKGROUND OF THE INVENTION

To discourage the burglary of premises whose residents may be away therefrom overnight or for a number of days, it is common to provide automatic timers or photocell-controlled light circuits. The drawbacks of photocell-controlled light circuits are that the lights remain on all night resulting in the wasting of electricity and provide an indication to a burglar that the house involved may be unoccupied and controlled by a photocell-controlled timer. Automatic timers are perhaps a more effective and convenient means for controlling the energization of the light circuits involved, but they suffer from a number of disadvantages. For example, if one desires to utilize timers in a house which was not initially built with timers installed in oversize electrical boxes in the walls thereof, the timers must either be plugged into outlet sockets where they are very difficult to see and adjust, or placed in a more accessible location, such as tables which results in unacceptable clutter. In any event, automatic timers of the prior art are not easy to adjust because of the procedure of adjustment required and the difficulty of reading the time setting numbers and must be readjusted for the varying time of sunset through the year and changes from standard time to daylight saving time and vice versa.

SUMMARY OF THE INVENTION

In accordance with one of the features of the present invention, the functions of an electronic timer and manual on-off wall switch are combined uniquely into a single assembly preferably having a single manually operable control member selectively adjustable to stable manually controlled power turn-on and turn-off positions to turn the lights involved on and off in the normal manner. The control member also preferably has three other positions, one of which is an unstable timer ON SET position to which the control arm is momentarily moved preferably in the same direction as it must be moved to its normal manually controlled turn-on position) at the particular time of the day when it is desired to set the timer to turn on the lights involved when timer controlled, an unstable timer OFF SET position to which the control arm is momentarily moved (preferably in the same direction as it must be moved to its normal manually controlled turn-off position) at the particular time of the day when it is desired to set the timer to turn off the lights involved when timer controlled. To operate the lights involved in an automatic timing cycle in accordance with the on and off setting adjustments just described, the control member is merely moved to a timer on position where the lights are turned on and off automatically at the preset timing periods each day without further adjustment.

In accordance with a preferred aspect of the invention, the aforesaid timer on and timer off setting operations effect resetting of timer turn-on and turn-off pulse counters which reset themselves to a zero count every 24 hours. Timing pulses are fed to the self resetting pulse counters which generate one output pulse or signal every 24 hours relative to the time they are reset. The pulse or signal output of the timer turn-on pulse counter preferably sets a flip-flop circuit which controls a thyristor or the like, which then couples the hot side of an AC power system to a line or conductor feeding the power outlet sockets in the section of the room or house being controlled. The pulse or signal output of the timer turn-off pulse counter resets the flip-flop circuit which renders the thyristor non-conductive to decouple the AC power system from the bus.

The above and other features of the invention will become apparent upon making reference to the specifications to follow, drawings and claims.

EXEMPLARY EMBODIMENT OF THE INVENTION

Figure 1:
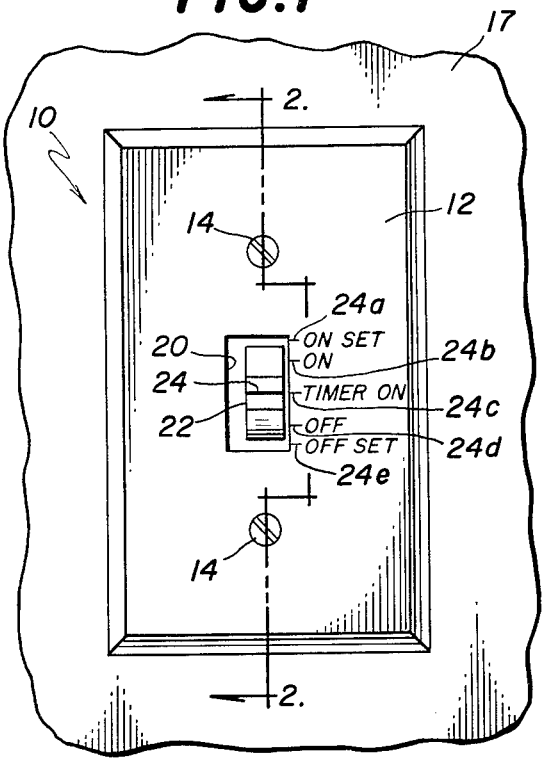
FIG. 1 is a view of a face plate of the timer and manual on-off switch assembly of the invention, showing different marked positions to which a manually operable control arm may be moved to carry out the different functions of the invention.

Referring now to FIG. 1, there is shown a timer and manual on-off switch assembly of the present invention generally indicated by reference numeral 10. This assembly shown in FIG. 1 includes a cover plate 12 anchored by screws 14—14 to a bracket 16 attached to a housing assembly to be described. The bracket 16 is mounted by suitable securing means such as screws 18—18 to an electrical box 19 which, in turn, is anchored to wall 17. Projecting from an opening 20 in the cover plate 12 is a toggle arm 22. As illustrated, the toggle arm 22 can be moved to five different vertical positions identified by position indicating lines **24*a*, 24*b*, 24*c*, 24*d* and 24*e* applied to the face of the cover plate 12. The upper position indicating line 24*a* identifies an unstable ON SET position when a reference projection 24 on the front face of the toggle arm 22 is moved opposite the position indicating line 24*a***. The toggle arm can only remain in this ON SET position when the user forces the toggle arm in that position.

Release of the toggle arm from this position will cause the toggle arm to move to a stable ON position identified by the position indicating line 24*b* where the lights involved are turned on in the usual manner. As previously indicated, the toggle arm 22 is moved to a timer ON SET position at the instant of time it is desired to set an automatic timing cycle which turns the lights on at the particular moment where the user moves the toggle arm to this ON SET position.

The toggle arm 22 can also be stably set to a central timer turn-on position identified as the TIMER ON position identified by position line 24*C*. However, the toggle arm 22 assumes an unstable position in this TIMER ON position unless the toggle arm is shifted laterally to the right, where, in a manner to be explained, the toggle arm is held in such position. When the toggle arm 22 is in its central TIMER ON position, the control apparatus to be described acts in its timer mode where the lights involved are automatically turned on and off during a given timing cycle which repeats automatically each 24 hour period.

The toggle arm 22 can also be moved to a bottom stable OFF position identified by position line 24*d* on the face plate 12, at which position the lights involved would be turned off. The toggle arm 22 can be moved to a lowermost unstable OFF SET position identified by a position line 24*e* on the face plate 12. The operator must force the toggle arm into this bottommost position, which sets the off time of the timer involved.

The timer and manual on-off switch assembly 10 as illustrated includes a main rectangular housing body 26 (FIGS. 2 and 5) which may be of a molded synthetic plastic material having a central spring-receiving recess 26*a* in which a curved spring 28 is seated. This spring 28 exerts force on the toggle arm in a manner to be described and forces the same into its stable upper ON position or its stable lower OFF position. The main housing body 26 as illustrated supports a switch unit 30. The switch unit 30 may have a triac or thyristor element 32 (FIGS. 2 and 5) forming a part thereof with load and control terminals to be described. A pair of metal screw terminals 34–36 extend from metal terminal plates 38 and 40, respectively, the plates 38 and 40 fitting into mounting channels 42 and 44 respectively formed within the housing body 26. The terminal plates 38 and 40 are wired to the load terminals of the thyristor element 32. The screw terminals 34 and 36 are to be connected to the "hot" conductor of an AC power system and an AC load output bus to be described. The main housing body 26 also has a terminal plate 46 with a screw terminal 48 projecting therefrom the terminal plate 46 fitting within guide channels 50 formed in the housing body 26. The terminal plate 48 is wired to neutral or ground.

Figure 2:
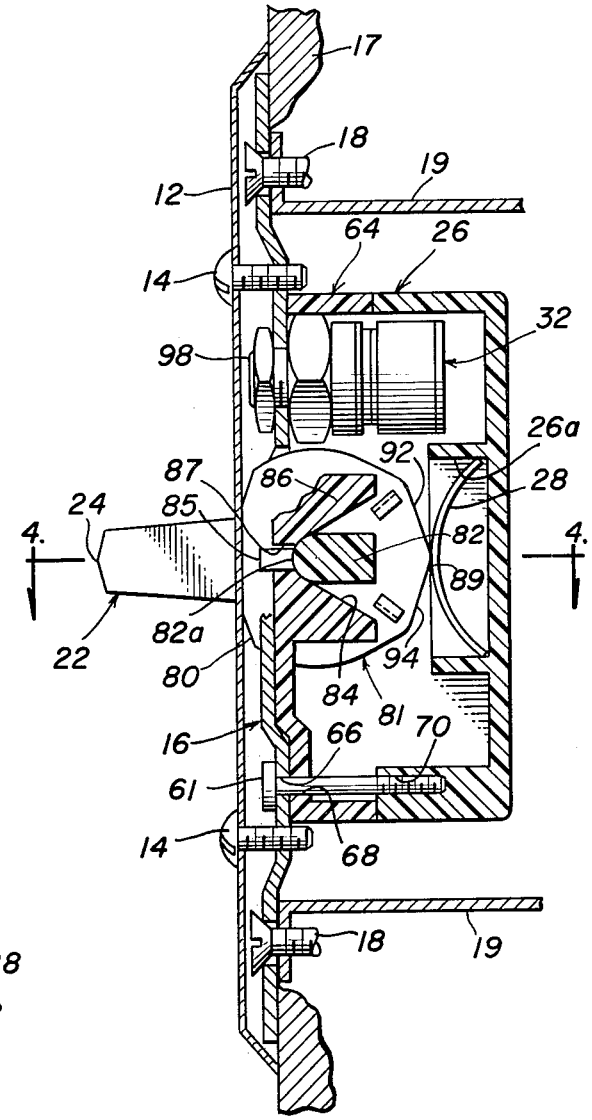
FIG. 2 is a greatly enlarged vertical sectional view through the timer and manual on-off switch assembly of FIG. 1, taken along section line 2—2 therein, and shows the control arm of the assembly in its TIMER-ON operating position.

The housing body 26 has circuit board-receiving channels 52—52 receiving a printed circuit board 54 having, among other things, a set of switch contact-forming conductive areas or segments 56*a*, 56*b*, 56*c*, 56*d* and 56*e* positioned along a circular arc. The circuit board 54 may also contain various integrated or other circuits formed thereon and may also support other circuit components indicated by reference numerals 58, 60, 62 and 64. The main housing body 26 has attached thereto screws 63–61 a housing cover 64 which may be made of molded synthetic plastic material. The screw 61 is shown in FIG. 2 passing through an aperture 66 in a bracket 16 and an aperture 68 in the housing cover 64 and threads into a threaded aperture 70 in the main housing body 26. The screw 63 passes through an aperture 72 in the housing cover 64 and threads into a threaded aperture 74 in the main housing body 26. The thyristor element 32 has a threaded projection 32*a* which passes through the aperture 76 of the housing cover 64 and an aperture 96 in the bracket 16, and the threaded projection 32*a* is anchored to the bracket 16 by a nut 98.

Figure 3:
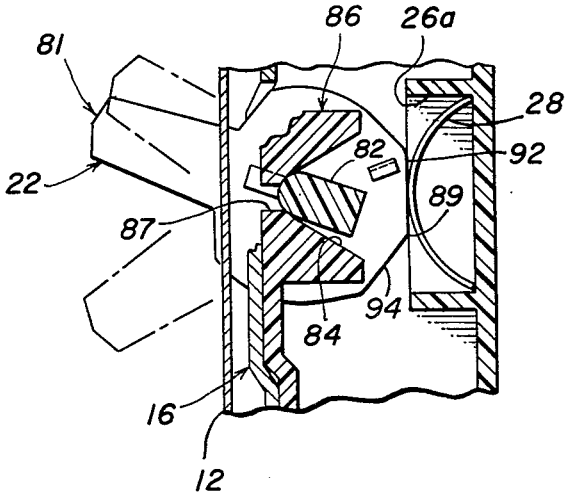
FIG. 3 is a view corresponding to a part of FIG. 2, and shows the control arm in a stable manual light turn-on position, and also shows in dashed lines the extreme upper and lower positions of the control arm representing on set and off set setting positions thereof.
Figure 4:
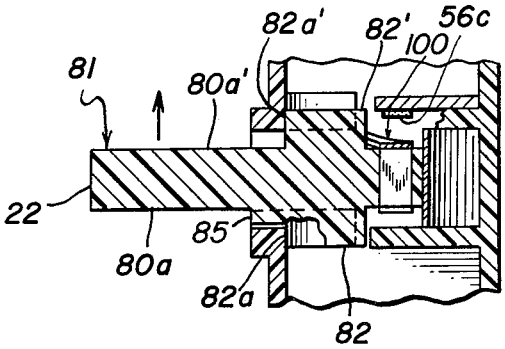
FIG. 4 is a horizontal sectional view through FIG. 2, taken along section line 4—4 therein.

The toggle arm 22 is part of a toggle arm member 81 which may be made of molded synthetic plastic material, and projects from a main body portion 80 thereof. Projecting laterally from the opposite faces 80*a* –80*a*′ (FIG. 4) of the main body portion 80 of the toggle arm member 81 are pivot forming projections 82–82′ having rounded front surfaces 82*a* –82*a*′ fitting respectively within the narrow end portions of forwardly tapered bearing-forming recesses 84–84′ formed by rearward projections 86–86′ of the housing cover 64 on opposite sides of the aperture 76. The spring 28 urges the toggle arm member 81 into the front narrow ends of the recesses 84–84′. Projecting from the face 80*a* of the main body portion 80 of the toggle arm member 81 is a key 85 which, only in the TIMER-ON position of the toggle arm 22, can be shifted laterally to the right into a locking keyway 87 (FIG. 5) opening onto the aperture 76 of the housing cover 64 where the toggle arm member remains held frictionally under the force of spring 28 pressing against a pointed rear portion 89 thereof. When the toggle arm member 81 is shifted to the left within the recess 76 where the key 85 is removed from the keyway 87, the spring 28 will urge the toggle arm member into a stable upper or lower position where a flat 92 or 94 on the rear end of the toggle arm member is engaged by the spring 28. These are the upper ON and lower OFF positions of the toggle arm member previously described. The toggle arm 22 can be moved upwardly or downwardly to the ON SET and OFF SET positions from these upper and lower stable positions only by applying a manual force in an upward or downward direction against the toggle arm 22. It can be seen from FIG. 3, for example, that release of such an upward or downward force upon the toggle arm 22 will cause the toggle arm to return to the stable upper or lower stable ON or OFF position as described.

Figures 5, 7, 8, 9, 10:
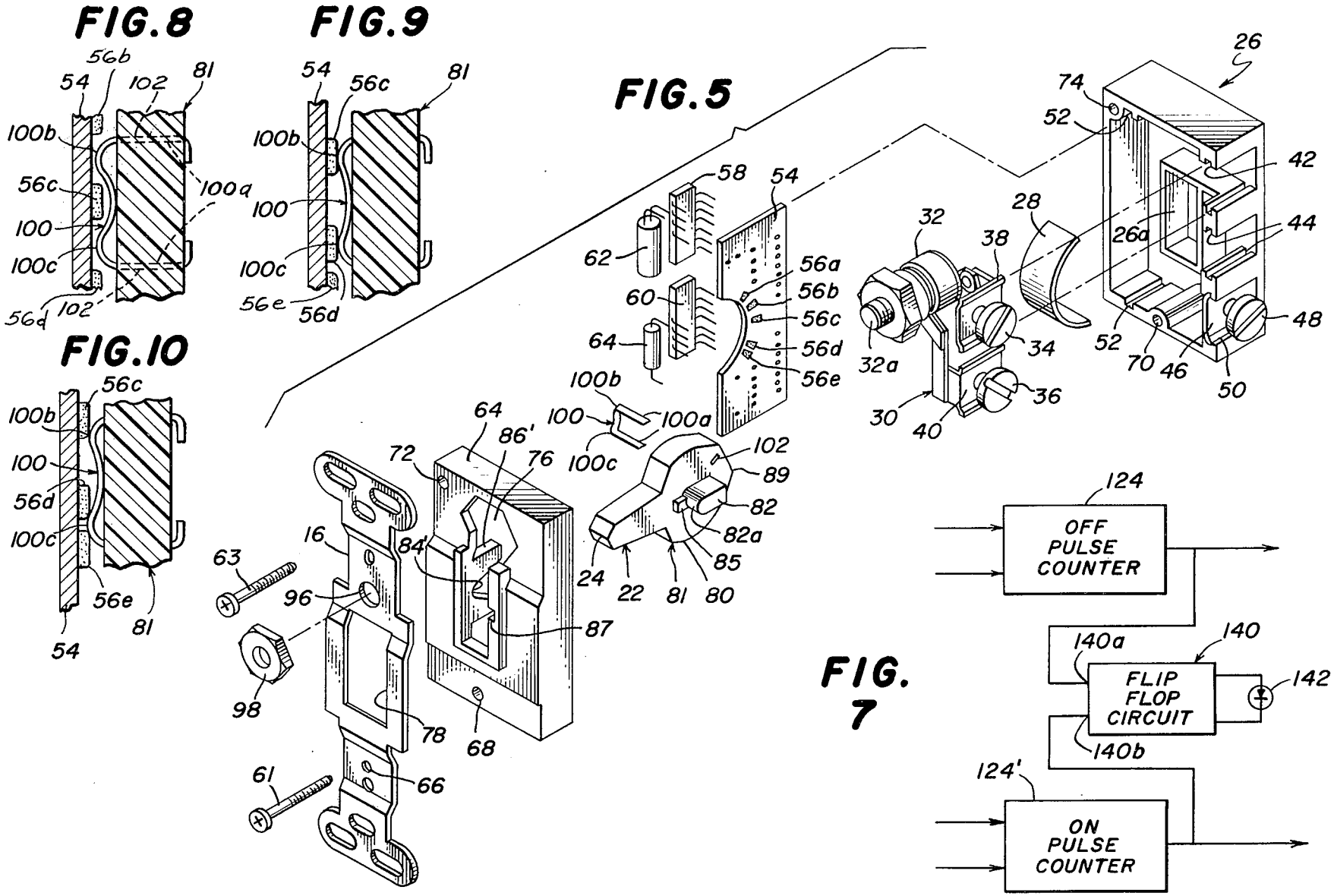
FIG. 5 is an exploded view of the various parts making up the timer and manual on-off switch assembly of FIG. 1, except for the cover plate and electrical box which are not shown therein.
FIG. 7 is a view of a part of the circuit shown in FIG. 6 to which is added a circuit condition indicating circuit shown in block form.
FIGS. 8 through 10 are enlarged fragmentary views partly in section showing the relationship of the bridging portions of the bridging strip with respect to the contact segments on the circuit board when the control arm of the switch assembly is moved to various positions.

The toggle arm member 81 has secured thereto a contact-bridging strip 100 (FIGS. 4 and 5) which is shown in FIG. 5 as being an initially wave-shaped member having legs 100*a*—100*a* passing through apertures 102—102. Wiper-forming bridging portions 100*b*–100*c* of this strip 100 extend along the left-hand face of the toggle arm member 81 as viewed on the drawings to form a contact wiper adapted to engage at any one time none, one, two or three of the middle to end contact segments 56*a*, 56*b*, 56*c*, 56*d* and 56*e* on the circuit board 54. When the toggle arm member 81 is in its left-hand position (i.e., where the key 84 is not inserted within the keyway 87), the wiper portions 100*b*–100*c* of the strip 100 are in the plane of the right side of circuit board 54. While the toggle arm member 81 is in this lefthand position, when the toggle arm 22 is moved past its TIMER ON position, the wiper portions 100*b* or 100*c* will be on either side of the segment 56*c* (See FIG. 8). When the toggle arm 22 is raised from this position into its upper stable ON position where it is opposite the ON position line 24*b*, the wiper portion 100*c* engages the ON contact segment 56*d*, and the wiper portion 100*b* engages the segment 56*c* (See FIG. 9). When the toggle arm 22 is moved upwardly slightly beyond this position where it is opposite the ON SET position line 24*a* on the face plate 12, the wiper portion 100*c* preferably contacts both the contact segment 56*d* and the contact segment 56*e* while the wiper portion 100*b* engages the segment 56*c* (See FIG. 10).

Similarly, when the toggle arm 22 is moved into its lower stable OFF position opposite the position indicating line 24*d* on the face plate 12, the wiper portion 100*b* of the contact strip 100 engages the OFF segment 56*b*, and the wiper portion 100*c* engages the segment 56*c*. When the toggle arm 22 is pushed slightly downwardly beyond this position to be opposite the OFF SET position indicating line 24*e*, the wiper portion 100*b* will contact both the contact segments 56*a* and 56*b* while the wiper portion 100*c* engages the segment 56*c*.

Figure 6:
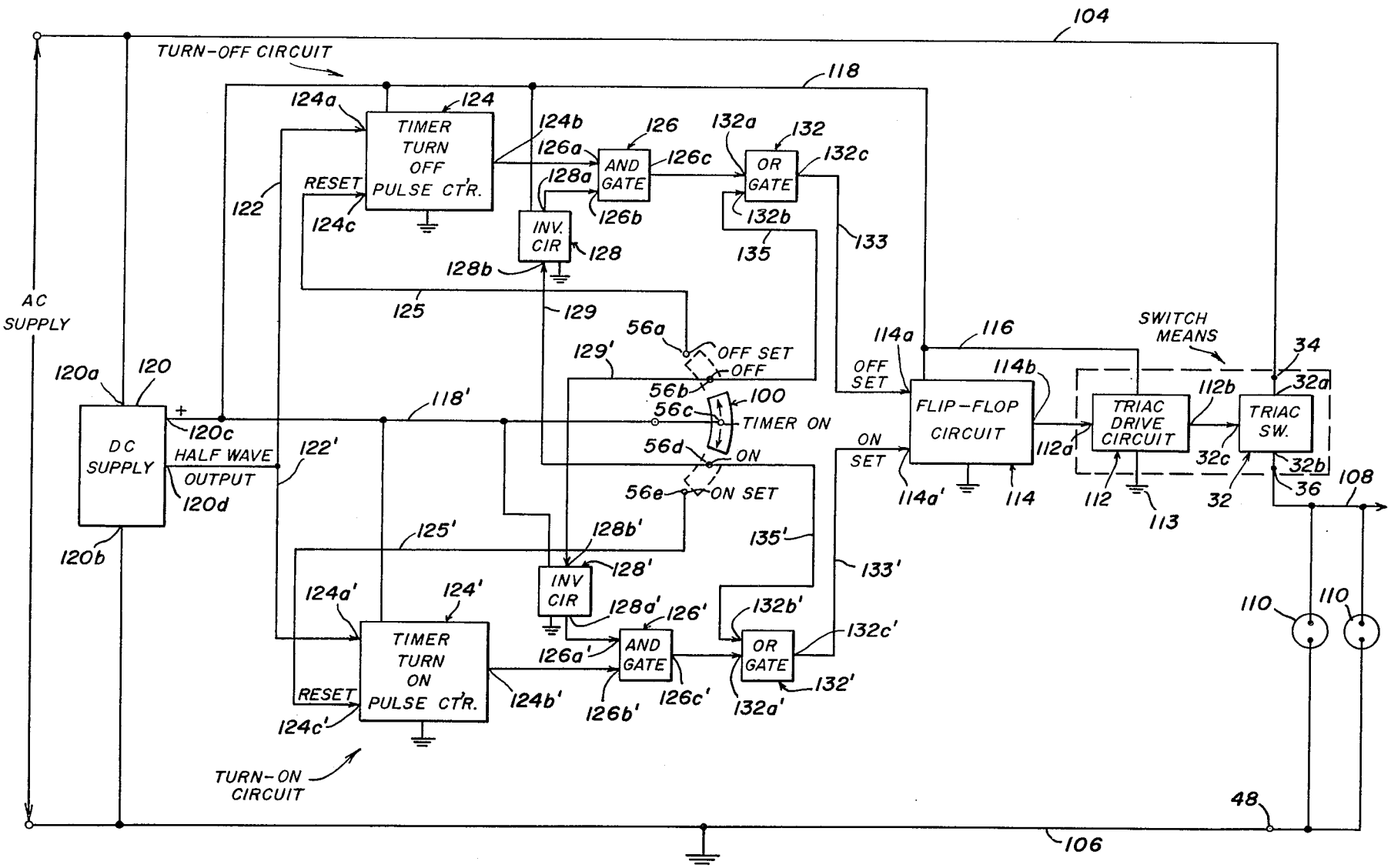
FIG. 6 is a block diagram of a light control circuit forming part of the timer and manual on-off switch assembly of the invention, which circuit is operated or prepared for operation by the different positions of the control arm thereof.

The various circuit operations performed in the different positions of the toggle arm 22 will now be explained in connection with the block diagram shown in FIG. 6 of the control circuitry used in the preferred form of the present invention. FIG. 6 shows main AC power systems conductors 104 and 106, the power connector 104 being what is referred to as a "hot" conductor and the conductor 106 being what is sometimes referred to as a neutral or ground conductor. A power or control bus 108 is shown to which one terminal of various AC outlet sockets 100 are connected. The other terminal of each of the sockets 110 is connected to the neutral or ground conductor 106. The plug connectors of lamps or other electrical devices are plugged into the sockets 110 in a given room of the building involved. Manifestly, light fixtures and other electrical devices can be permanently wired between the power bus 108 and the ground conductor 106.

The present invention controls switch means which selectively open or close a branch circuit between the "hot" conductor 104 and the power bus 108. In the particular circuit illustrated in FIG. 6, the switch means is, as previously described, a triac switch 32 having load terminals 32*a* and 32*b* and a control terminal 32*c*. The triac switch is a bi-directional semiconductor device which, when a control voltage is fed between its control terminal 32*c* and one of its load terminals 32*a* or 32*b*, will be driven into a conductive state which remains independently of the removal of the control signal therefrom, until its load current drops to zero. Since the voltage on the power conductors 104 and 106 is an alternating voltage, the control terminal 32*c* must continue to receive a control signal of each half cycle the voltage appearing on the power conductors 104 and 106.

The drive current for the triac switch 32 is obtained from a suitable triac drive circuit 112 which may be of conventional design. Such a drive circuit is generally energized from a source of DC potential and, to this end, a power conductor 116 is shown extending from the triac drive circuit 112 to a DC power bus 118 extending to the output 120*c* of a DC power supply 120. The triac drive circuit also has a connection to reference ground at 113, an input terminal 112*a* fed from the output of a bi-stable or flip-flop circuit 114 and an output terminal 112*b* which is connected to the control terminal 32*c* of the triac switch 32. The triac switch 32 and the triac drive circuit 112 can be replaced by an ordinary relay circuit controlled by the output of the flip-flop circuit 114.

The flip-flop circuit 114 has two bi-stable states, one of which state (referred to as switch closing state) results in a DC voltage at its output terminal 114*b* which will operate the triac drive circuit 112 in a manner which will cause the triac switch 32 to be rendered conductive at the beginning of each half cycle of the voltage on the power conductors 104–106. In its switch opening state, the flip-flop circuit 114 provides zero or near zero voltage at its output terminal 114*b* which will not operate the drive circuit 112. The flip-flop circuit has an OFF SET pulse input terminal 114*a* for receiving a pulse which triggers the flip-flop circuit 114 to its switch opening state when the triac switch 32 is in its circuit closing condition, and an ON SET pulse input terminal 114*a'* for receiving a pulse which triggers the flip-flop circuit 114 to its switch closing state. The circuits which generate these set pulses fed to the ON and OFF SET input signal terminals 114*a* and 114*a'* will now be described.

The latter circuits to be described are energized from the aforementioned DC power supply 120, which may include a conventional filtered, full wave rectifier section which is energized at its input terminals 120*a* and 120*b* from the power connectors 104 and 106. The power-supply 120 also has an unfiltered halfwave rectifier section which produces a half wave rectified output voltage at output terminal 120*d* which compares pulses of a given polarity which are fed by conductors 122 and 122' respectively to the input terminals 124*a* and 124*a'* of timer turn-off pulse counter 124 and timer turn-on pulse counter 124'.

The timer turn-off and timer turn-on pulse counters 124 and 124' may both be identical self-resetting ring counters which are fed the frequency of the A.C. supply times 86,400 pulses, i.e., 5,184,000 pulses or 60 hertz times 60 seconds times 60 minutes times 24 hours in the case of 60 hertz A.C. supply, over a 24-hour period and reach a maximum count of 5,184,000 so the next pulse resets the same to zero, at which time a single pulse is produced at the output terminals 124*b* and 124*b'* thereof. These counters can be externally reset to zero count by the feeding of a reset pulse to reset input terminal 124*c* or 124*c'* thereof.

The timer turn-off and turn-on pulse counters 124 and 124' are externally reset to zero count by respectively momentarily moving the toggle arm 22 respectively to the OFF SET and ON SET positions previously described. The once per 24 hour pulse output appearing at output terminal 124*b* of the timer turn-off pulse counter 124 is fed to the input terminal 126*a* of an AND gate 126 having another input terminal 126*b* fed from the output terminal 128*a* of an inverter circuit 128. The inverter circuit 128 has an input terminal 128*b* connected by a conductor 129 to the ON contact segment 56*d* on the circuit board 54. When the wiper portion 100*c* of the contact member 100 carried by the toggle arm member 81 is moved to its stable ON position, the wiper portion will continuously engage the contact segment 56*d*, and thereby couple to the input terminal 128*b* of the inverter circuit 128 the DC voltage (assumed to be positive in the example of the invention being described) present on a bus 118' extending to the positive output terminal 120*c* of the DC power supply 120. The inverter circuit is a well known circuit which inverts the polarity or sense of voltage at the input thereof. In the present example, for example, when a positive voltage is fed to the input terminal 128*b* of the inverter circuit 128, ground potential may appear at the output terminal 128*a* and, conversely, where there is no input fed to the input terminal 128*b*, the output terminal 128*a* will have a positive DC voltage thereat. If it is assumed that the pulse produced by the timer turn-off pulse counter 124 is a positive pulse generated each 24 hours, the AND gate 126 will, during the generation of that pulse, pass the pulse from output counter 124 to the gate output terminal 126*c*, to set the flip-flop circuit 114 to switch opening state.

When the toggle arm 22 is moved into the ON position, a positive voltage is fed to the input of the inverter circuit 128 which results in a gate opening potential at the inverter output terminal 128*a* which prevents the output pulse of the timer turn-on pulse counter from passing through the AND gate 126. However, when the toggle arm 22 is in the TIMER ON position, the pulse output of the timer turn-off pulse counter 124 will pass through the AND gate 126 to the input 132*a* of an OR gate 132 since the inverter circuit will then provide a positive DC voltage at its output 128*a* which opens the AND gate 126. As is well known, an OR gate passes the signals at any of its inputs to its output (132*c*) thereof. This output is coupled by a conductor 133 to the off set input terminal 114*a* of the flip-flop circuit 114 to set the same into its switch opening state.

The OR gate 132 has an input terminal 132*b* coupled by a conductor 135 to the OFF contact segment 56*b* of the circuit board 56. The contact segment 56*b* is the segment which is engaged by the wiper portion 100*b* of the contact member 100 carried by the toggle arm member 81 when the toggle arm 22 is in its stable OFF position. At that time, the positive voltage appearing on the wiper portion 100*b* will be coupled through the contact segment 56*b* and the OR gate, to operate the flip-flop circuit 114 to its switch opening state. Thus, the flip-flop circuit 114 is operated in its switch opening state when it receives a pulse from the output of the timer turn-off pulse counter 124, which is only possible when the toggle arm 22 is in its TIMER ON position and the counter 124 generates a pulse as described, or when the toggle arm 22 is in the stable OFF position.

The manner in which the timer turn-on pulse counter 124' operates to set the flip-flop circuit 114 to its switch closing condition is similar to the manner in which the timer turn-off pulse counter 124 operates the same. Accordingly, the timer turn-on pulse counter 124' has a reset input terminal 124*c'* which is coupled by a conductor 125' to contact segment 56*e* of the circuit board 54 which contact segment is momentarily engaged by the wiper portion 100*c* of the contact strip 100 to couple a positive DC voltage thereto when the toggle arm 22 is momentarily moved to its ON SET position. The timer turn-on pulse counter 124' is then set to zero count so that it will generate a pulse 24 hours later. In the circuit being described, the pulse appearing at the output terminal 124*b'* of the timer turn-on pulse counter 124' is coupled to the input terminal 126*b'* of an AND gate 126'. The AND gate 126' has another input terminal 126*a'* coupled to the output terminal 128*a'* of an inverter circuit 128'. The inverter circuit 128' has an input terminal 128*b'* coupled by conductor 129' to the contact segment 56*b* of the printed circuit board 54. As previously indicated, this contact segment 56*b* will have the positive voltage of the bus 118' applied thereto when the toggle arm 22 is in its OFF position. In such case, the output of the inverter circuit 128' will be other than the voltage necessary to open the AND gate 126' when a pulse appears at the output of the timer turn-on pulse counter 124'. Then, when the toggle arm is in the OFF position, the output of the timer turn-on pulse counter 124' cannot pass through the AND gate 126' to operate the flip-flop circuit 114 in the switch closing state. The AND gate 126' has an output terminal 126*c'* coupled to the input terminal 132*a'* of an OR gate 132' which will pass the pulse fed to its input terminal 132*a'* to its output terminal 132*c'*. The output terminal 132*c'* is coupled by a conductor 133' to the on set input terminal 114*a'* of the flip-flop circuit 114.

The OR gate 132' has an input terminal 132*b'* coupled by a conductor 135' to the segment 56*d* of the circuit board 54 which is engaged by the wiper portion 100*c* of the contact strip 100 to couple a positive voltage thereto when the toggle arm is in its ON position. This positive voltage, when the toggle arm 22 is in its ON position, will be coupled through the OR gate 132' to the input terminal 114*a'* of the flip-flop circuit 114 to operate the flip-flop circuit into its switch closing state.

Refer now to FIG. 7 which shows an addition to the circuit of FIG. 6 which provides a visual indication when the timer turn-off pulse counter and the timer turn-on pulse counter are operating properly to generate a pulse at the desired time for effecting a timer controlled power on or power off operation. To this end, a flip-flop circuit 140 is added to the circuit of FIG. 6, which flip-flop circuit 140 may operate a light emitting diode or other light source 142 which is mounted so as to be visible through an opening or window in the face plate 12. The flip-flop circuit 140 has a reset input terminal 140*a* coupled to the output terminal 124*b* of the timer turn-off pulse counter 124, and has a set input terminal 140*b* coupled to the output terminal 124*b'* of the timer turn-on pulse counter 124'. The flip-flop circuit 140 is triggered between its opposite stable states by the outputs from the timer pulse counters 124 and 124'. The light emitting diode 142 or other light source is connected to the output of the flip-flop circuit 140 so that it will be energized during the time that the timer would normally close the triac switch 32 if the toggle arm 22 were in its TIMER-ON position. If the operator believes that he had set his timer operation so as to turn the power on and off at particular times, he can double check whether the timer is properly set for such operation independently of the position of the toggle arm 22, by noting the particular time the light emitting diode 142 becomes energized and de-energized.

The present invention provides a very simple means to set and operate a combination timer and manual on-off switch which can be made at a rather modest cost by use of integrated circuits and the like which are sufficiently compact to fit within a standard wall switch housing as described. Numerous modifications may be made in the most preferred form of the invention described without deviating from the broader aspects of the present invention.

I claim:

1. A combination timer and manual on-off switch comprising: manually operable means to five different conditions, one condition being a power turn-on condition, another being a power turn-off condition, another being a timer on setting condition, another being a timer off setting condition, and another being a timer turn-on condition; a pair of power line input terminals and an outlet conductor terminal; switch means coupled between one of said power input terminals and said outlet conductor terminal for coupling and uncoupling said one power line input terminal to and from said outlet conductor terminal; and control means responsive to the different conditions of said manually operable means for closing said switch means when the manually operable means is in said turn-on condition and for opening said switch means when the manually operable means is in said turn-off condition; the control means also including timer turn-on signal generating means responsive to the particular moment when said manually operable means is moved momentarily to said timer on setting condition for generating a switch closing signal every 24 hours from the moment said manually operable means is momentarily moved to said timer on setting condition, timer turn-off signal generating means responsive to the particular moment when said manually operable means is moved momentarily to said timer off setting condition for generating a switch opening signal every 24 hours from the moment said manually operable means is momentarily moved to said timer off setting condition, and signal responsive means responsive to the generating of said switch closing and switch opening signals when said manually operable means is in said timer turn-on condition for respectively closing and opening said switch means when said signals are respectively generated.

2. The combination timer and manual on-off switch of claim 1 wherein operation of said manually operable means to said power turn-on condition does not disrupt the closure of said switch means resulting from the previous operation of the manually operable means to said power turn-on condition.

3. The combination timer and manual on-off switch of claim 1 wherein said timer turn-on and timer turn-off signal generating means continue to generate said signals at a time determined by the time of operation of said manually operable means respectively to said timer on and timer off setting conditions independently of the subsequent operation of said manually operable means to said other conditions thereof.

4. The combination timer and manual on-off switch of claim 3 wherein the control means includes circuit connections which render the signals generated by said timer on and timer off signal generating means ineffective to control said switch means when said manually operable means is operated to said power turn-on and turn-off conditions.

5. The combination timer and manual on-off switch of claim 1 wherein said timer on and timer off signal generating means are self-resetting pulse counters which self-reset themselves to a reference count every 24 hours.

6. The combination timer and manual on-off switch of claim 1 wherein said signal responsive means includes a bistable circuit which is set into a switch closing condition by the switch closing signal from said timer turn-on signal generating means and is set into a switch opening condition by the switch opening signal from said timer turn-off signal generating means.

7. A combination timer and manual on-off switch comprising: a manually operable control member movable to five different positions, one position being a power turn-on position, another being a power turn-off position, another being a timer on setting position, another being a timer off setting position, and another being a timer turn-on position; a pair of power line input terminals and an AC outlet conductor terminal; switch means coupled between one of said power input terminals and said outlet conductor terminal for coupling and uncoupling said one power line input terminal to and from said outlet conductor terminal; and control means responsive to the different positions of said control member for closing said switch means when the control member is in said turn-on position and for opening said switch means when the control member is in said turn-off position; the control means also including timer turn-on signal generating means responsive to the particular moment when said control member is moved momentarily to said timer on setting position for generating a switch closing signal every 24 hours from the moment said control member is momentarily moved to said timer on setting position, timer turn-off signal generating means responsive to the particular moment when said control member is moved momentarily to said timer off setting position for generating a switch opening signal every 24 hours from the moment said control member is momentarily moved to said timer off setting position, and signal responsive means responsive to the generation of said switch closing and switch opening signals when said control member is in said timer turn-on position for respectively closing and opening said switch means when said signals are respectively generated.

8. The combination timer and manual on-off switch of claim 7 wherein said timer on and timer off setting positions of said control member are respectively located just beyond the power turn-on and power turn-off positions thereof.

9. The combination timer and manual on-off switch of claim 8 wherein said timer on and timer off setting positions of the control member are unstable positions during which the control member remains in such position only so long as the operator holds the control member in such positions.

10. The combination timer and manual on-off switch of claim 9 wherein movement of control member just beyond said power turn-on position does not disrupt the closure of said switch means resulting from the previous movement of the control member to said power turn-on position.

11. The combination timer and manual on-off switch of claim 7 wherein said timer turn-on and timer turn-off signal generating means continue to generate said signals at a time determined by the time of movement of said control member respectively to said timer on and timer off setting positions independently of the subsequent positioning of said control member to said other positions thereof.

12. A combination timer and manual on-off switch system comprising: a pair of power line input terminals; a control conductor terminal; switch means coupled between one of said power line terminals and said control conductor terminal for respectively coupling and decoupling said one power line terminal to said control conductor terminal; bistable means settable into a first condition for closing said switch means and a second condition for opening said switch means; a timer turn-on pulse counter and a timer turn-off pulse counter; said pulse counters being self-resetting counters which reset themselves to a given reference count after a given limited count is reached so the next pulse received thereby resets the same to said reference count; a source of pulses fed to said pulse counters which cause the counters to reach said limited count every 24 hours after being reset to said reference count; means responsive to the limited or reference count in said timer turn-on pulse counter for operating said bistable means to its switch closing condition and responsive to the limited or reference count in said timer turn-off pulse counter for operating said bistable means to said switch opening condition; manually operable means manually operable to power turn-on, power turn-off, timer on setting, timer off setting and timer turn-on conditions; and control means including means responsive to the operation of said manually operable means to said timer on setting condition for resetting said timer turn-on pulse counter to said reference count, means responsive to the operation of said manually operable control means to said timer off setting condition for resetting said turn-off pulse counter to said reference count, means responsive to the operation of said manually operable means to said power turn-on condition for operating said bistable means to said switch closing condition independently of the condition of said pulse counters, means responsive to the operation of said manually operable means to said power turn-off condition for operating said bistable means to said switch opening condition independently of the condition of said pulse counters, and means responsive to the operation of said manually operable means to said timer turn-on condition for rendering said bistable means responsive to the counter in said pulse counter means.

13. The combination timer and manual on-off switch of claim 12 wherein there is provided indicator means which indicate when at least one of said pulse counters reaches said limited or reference count.

14. A combination timer and manual on-off switch of claim 13 wherein said indicator means includes a second bistable means which is set and reset to opposite states when said counters are respectively operated to said limited or reference counts independently of a condition to which said manually operable means is operated, and a visible signalling means which provides a visible signal only when said bistable means is in one of said states.

15. A timer system comprising: a pair of power input terminals; a control conductor terminal; switch means coupled between one of said power line terminals and said control conductor terminal for respectively coupling and decoupling said one power input terminal to said control conductor terminal; bi-stable means settable into a first condition for closing said switch means and a second condition for opening said switch means; a timer turn-on pulse counter and a timer turn-off pulse counter; said pulse counters being self-resetting counters which reset themselves to a given reference count after a given limited count is reached so the next pulse received thereby resets the same to said reference count; a source of pulses fed to said pulse counters which cause the counters to reach said limited count every 24 hours after being reset to said reference count; means responsive to the limited or reference count in said timer turn-on pulse counter for operating said bistable means to its switch closing condition and responsive to the limited or reference count in said timer turn-off pulse counter for operating said bistable means to said switch opening position; manually operable means manually operable to timer on setting and timer off setting conditions; and control means including means responsive to the operation of said manually operable means to said timer on setting condition for resetting said timer turn-on pulse counter to said reference count, and means responsive to the operation of said manually operable control means to said timer off setting condition for resetting said turn-off pulse counter to said reference count.

16. The timer system of claim 15 wherein there is provided indicator means for indicating when said bistable means is in said switch closing and switch opening conditions.

17. The timer system of claim 16 wherein said indicator means includes a second bistable means which is set and reset to opposite states where the counters are respectively operated to said limited or reference count and signalling means which provides a visible indication only when second bistable means is in one of said states.

18. The timer system of claim 15 wherein there is provided indicator means which indicate the condition of said pulse counters.

* * * * *